US009017232B2

(12) United States Patent
Olivarez et al.

(10) Patent No.: US 9,017,232 B2
(45) Date of Patent: Apr. 28, 2015

(54) WEIGHTLIFTING SWIVEL WRIST HOOK

(71) Applicants: Dario Samuel Olivarez, McAllen, TX (US); David Manuel Olivarez, McAllen, TX (US)

(72) Inventors: Dario Samuel Olivarez, McAllen, TX (US); David Manuel Olivarez, McAllen, TX (US)

( * ) Notice: Subject to any disclaimer, the term of this patent is extended or adjusted under 35 U.S.C. 154(b) by 114 days.

(21) Appl. No.: 14/011,617

(22) Filed: Aug. 27, 2013

(65) Prior Publication Data

US 2014/0057762 A1 Feb. 27, 2014

Related U.S. Application Data

(60) Provisional application No. 61/693,538, filed on Aug. 27, 2012.

(51) Int. Cl.

| | |
|---|---|
| ***A63B 21/00*** | (2006.01) |
| ***A63B 21/072*** | (2006.01) |
| ***A63B 71/00*** | (2006.01) |
| ***A63B 21/065*** | (2006.01) |

(52) U.S. Cl.

CPC ..... *A63B 21/072* (2013.01); *A63B 71/0054* (2013.01); *A63B 21/065* (2013.01); *A63B 21/0726* (2013.01); *A63B 21/1469* (2013.01); *A63B 2209/08* (2013.01); *A63B 2209/10* (2013.01); *A63B 21/1442* (2013.01); *A63B 21/00181* (2013.01)

(58) Field of Classification Search

USPC ..... 482/105, 124, 106, 104, 108

See application file for complete search history.

(56) References Cited

U.S. PATENT DOCUMENTS

| | | | | |
|---|---|---|---|---|
| 5,169,364 | A * | 12/1992 | Donaldson | 482/105 |
| 5,588,940 | A * | 12/1996 | Price et al. | 482/105 |
| 5,591,089 | A * | 1/1997 | Huffines | 473/215 |

* cited by examiner

*Primary Examiner* — Jerome W Donnelly
(74) *Attorney, Agent, or Firm* — Roman Aguilera, III

(57) ABSTRACT

Disclosed herein is an invention directed to a weightlifting aid that an individual would utilize. More specifically, the present invention generally relates to a device directed to a weightlifting aid that an individual would couple to their hand to assist in the lifting of weights in an exercise or fitness environment. In one embodiment, the weightlifting swivel wrist hook is comprised of a user attachment element, a swivel element, and a hooking element. In another embodiment, the user attachment element is a wristband that allows attachment of the device to the user's wrist through various strapping means such as velcro, buttons, clips, and/or buckles. The swivel element is connected to the user attachment element and the hooking element and allows the hooking element to rotate about the swivel elements' pivot point. This movement of the hooking element allows the user to position the hooking element in an in use position or an out of use position. By allowing the hooking element to swivel or rotate to an out of use position, this will allow the user of the device to quickly move the hooking element out of the way without the user having to remove the device from their wrist.

12 Claims, 7 Drawing Sheets

WEIGHTLIFTING SWIVEL WRIST HOOK

CROSS-REFERENCE TO RELATED APPLICATIONS

This application claims the benefit under Title 35 United States Code §119(e) of U.S. Provisional Patent Application Ser. No. 61/693,538; Filed: Aug. 27, 2012, the full disclosure of which is incorporated herein by reference.

STATEMENT REGARDING FEDERALLY SPONSORED RESEARCH OR DEVELOPMENT

Not applicable

THE NAMES OF THE PARTIES TO A JOINT RESEARCH AGREEMENT

Not applicable

INCORPORATING-BY-REFERENCE OF MATERIAL SUBMITTED ON A COMPACT DISC

Not applicable

SEQUENCE LISTING

Not applicable

FIELD OF THE INVENTION

The present invention generally relates to a device directed to a weightlifting aid that an individual would utilize. More specifically, the present invention generally relates to a device directed to a weightlifting aid that an individual would couple to their hand to assist in the lifting of weights in an exercise or fitness environment.

BACKGROUND OF THE INVENTION

Without limiting the scope of the disclosed device, the background is described in connection with a novel device to efficiently and effectively assist an individual in the gripping and lifting of weights while exercising. The applications of this invention are directed to various environments such as but not limited to gyms, fitness facilities, and any other environments where an individual lifts weights.

When individuals are exercising and lifting weights, during certain exercises, the individual utilizes their hands to grip and lift the weights. Often times the individual's fingers and hands become fatigued before the targeted muscle group is fully exercised through all the repetitions. When this happens, the individual is no longer able to sustain the grip for lifting the weights, is no longer able to grip the weights properly, or is not able to step through the full range of motion of the exercise.

The field's prior art reflects many approaches and devices in alleviating this issue with lifting weights. Many of these prior art references utilize fixed aids that are obtrusive and introduce other issues for an individual lifting weights.

The main example of a weightlifting aid in the prior art is known as weightlifting hook. In this example, the hook is fastened to the individual's hand and the hook is positioned over the individuals palm and allows the individual to utilize the hook as a weightlifting aid. That is, the hook is attached to the weightlifting bar or an element of the weights to alleviate some or most of the load from the individuals' hand and fingers. The current state of the art reflects a fixed or dangling loose hook being attached to the individual.

In reality, a weightlifting aid that utilizes a fixed hook poses additional hazards and is invasive to the weightlifting environment. The current state of the prior art limits the effectiveness of an individuals' workout. With a fixed hook design, the hook is constantly in the way of the individuals' hands and fingers. That is, while the individual has the prior art devices strapped on, the individual constantly has their hands and fingers blocked by the hook which prohibits normal fitness activities such as grabbing their water bottle, lifting weight plates, adjusting workout equipment, and wiping their faces with a towel. To alleviate this obstruction of the hook, the individual would constantly have to remove and put back on the prior art devices causing inefficient and unproductive workouts. As a result, prior art hooks are not as reliable, safe, or effective and are difficult to use.

While all of the aforementioned devices may fulfill their unique purposes, none of them fulfill the need for a practical, effective, and efficient means for a weightlifting hook.

Therefore, the present invention proposes a novel device and method for a weightlifting swivel wrist hook that aids in the lifting of weights for an individual exercising.

BRIEF SUMMARY OF THE INVENTION

The present invention, therefore, provides a device directed to weightlifting aid that an individual would couple to their hand to assist in the lifting of weights in an exercise or fitness environment.

In one embodiment, the weightlifting swivel wrist hook is comprised of a user attachment element, a swivel element, and a hooking element. In another embodiment, the user attachment element is a wristband that allows attachment of the device to the user's wrist through various strapping means such as velcro, buttons, clips, and/or buckles. The swivel element is connected to the user attachment element and the hooking element and allows the hooking element to rotate about the swivel elements' pivot point. This movement of the hooking element allows the user to position the hooking element in an in use position or an out of use position. By allowing the hooking element to swivel or rotate to an out of use position, this will allow the user of the device to quickly move the hooking element out of the way without the user having to remove the device from their wrist.

In summary, the present invention discloses a device directed to a weightlifting aid that an individual would utilize. More specifically, the present invention generally relates to a device directed to a weightlifting aid that an individual would couple to their hand to assist in the lifting of weights in an exercise or fitness environment. By utilizing a hooking element, the individual is assisting in the gripping and lifting of weights while performing exercises.

BRIEF DESCRIPTION OF THE SEVERAL VIEWS OF THE DRAWINGS

For a more complete understanding of the features and advantages of the present invention, reference is now made to the detailed description of the invention along with the accompanying figures in which.

DETAILED DESCRIPTION OF THE INVENTION

Disclosed herein is an improved device directed to a weightlifting aid that an individual or user would couple to their hand to assist in the lifting of weights in an exercise or fitness environment. The numerous innovative teachings of the present invention will be described with particular reference to several embodiments (by way of example, and not of limitation).

Figure 1:
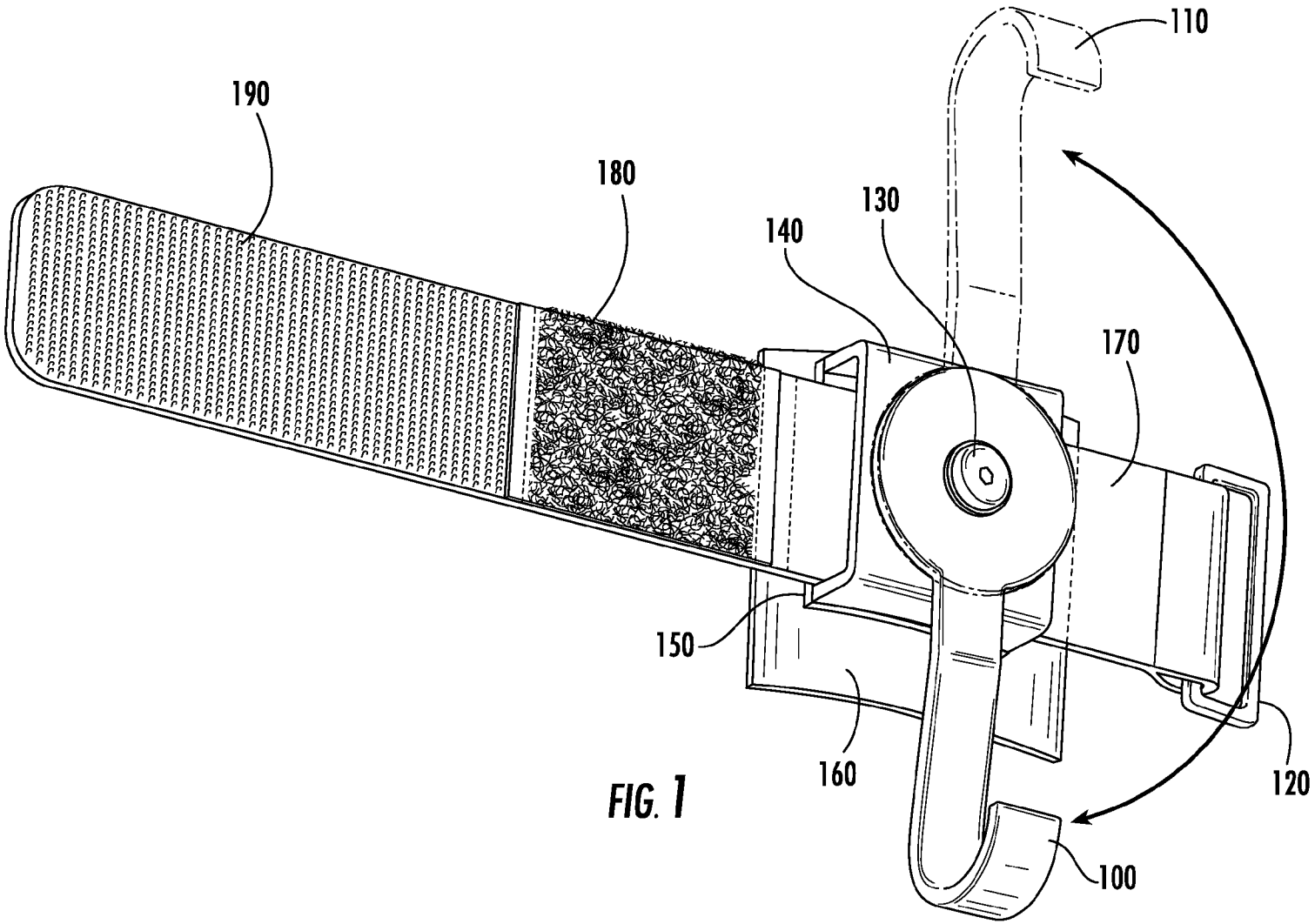
FIG. 1 is a top perspective view of the weightlifting swivel wrist hook in accordance with embodiments of the disclosure.

Reference is first made to FIG. 1, a top perspective view of the weightlifting swivel wrist hook in accordance with embodiments of the disclosure. Illustrated in this figure are the components in one embodiment of the device. They are as follows: the hook or hooking element 100, the buckle 120, the bolt 130, the upper metal base 140, the lower metal base 150, a cushion layer 160, the attachment strap or element 170, the female velcro portion 180 of the top side of the strap 170, and the male velcro portion 190 of the top side of the strap 170. The weightlifting swivel wrist hook attaches to the individual by the attachment strap or element 170 that employs an attachment means. In one embodiment, the attachment means is looping the attachment strap 170 through a buckle loop 120 and securing the attachment of the device through velcro 180, 190 positioned on the attachment strap 170. The attachment strap or element 170 is preferably made out of a flexible material such as a polymer or leather. In this illustration the weightlifting swivel wrist hook attaches to the individual's wrist by the attachment strap or element 170. The individual's hand would be on the right side of the attachment strap or element 170 with the hook 100 being positioned in the palm or fingers area. The cushion layer 160 may be comprised of various padding materials such as but not limited to leather, foam, cotton, and other materials which may be used to provide comfort when wearing the device and lifting weights. The upper metal base 140 and the lower metal base 150 provides a housing for the other components and allows the other components to be integrated. For example, the cushion layer 160 and the hook 100 may be attached to these metal base components 140, 150.

In the embodiment depicted, the hook 100 is attached to the upper metal base 140 by a bolt 130 with a star lock washer 135 residing underneath the bolt 130. The bolt 130 continues to a nut 155. The hook is preferably made out of a metal or other material to support heavy loads such as five hundred to fifteen hundred pounds. This allows the hook 100 to be rotated or positioned to a desired location. That is the individual using the device can position the hook 100 in an in use position as depicted in the figure, or rotate the position of the hook 100 to an out of the way position 110. Depicted in this illustration, the in use position may be labeled as the zero degree position and the out of the way position 110 can be labeled as the one hundred eighty degree position. This ability to move the position of the hook 100 is important. When an individual is using the weightlifting swivel hook, the hook 100 will be in an in use position and the individual can utilize the device to assist in the gripping and lifting of weights. With current weightlifting hooks, as previously discussed, the individual would have to remove and reattach the hook when performing physical activity tasks such as drinking from a water bottle, changing weight plates, adjusting the weight equipment, and wiping sweat from their face. This makes the workout or physical activity unproductive and not as efficient. In addition, the safety risk with accidently hitting yourself with the hook is great. For example, an individual trying to wipe the sweat from their face when they have forgotten about the fixed hook on their hand. With the device disclosed herein and claimed, the hook 100 can easily be moved away to avoid blocking the hands and fingers. The individual using the device can quickly maintain full use of their hands and fingers without having to remove the weightlifting hook. This not only makes the workout more efficient and effective, but also alleviates the safety issues.

Figure 6:
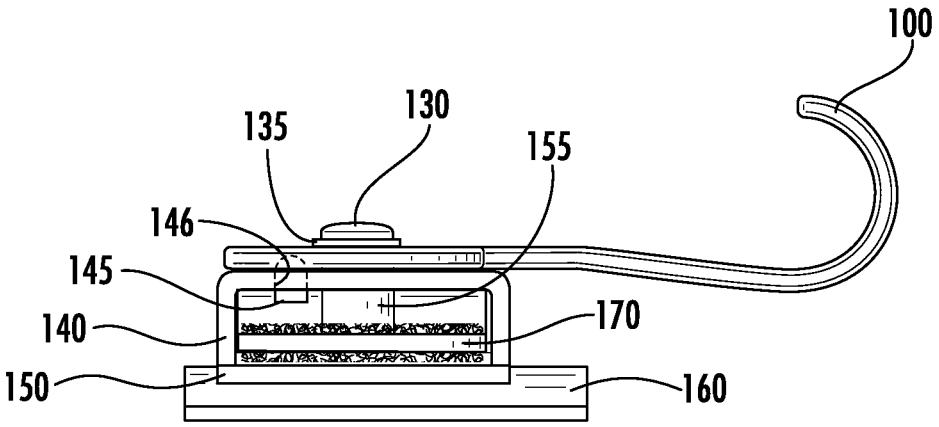
FIG. 6 is a right view of the weightlifting swivel wrist hook in accordance with embodiments of the disclosure.
Figure 8:
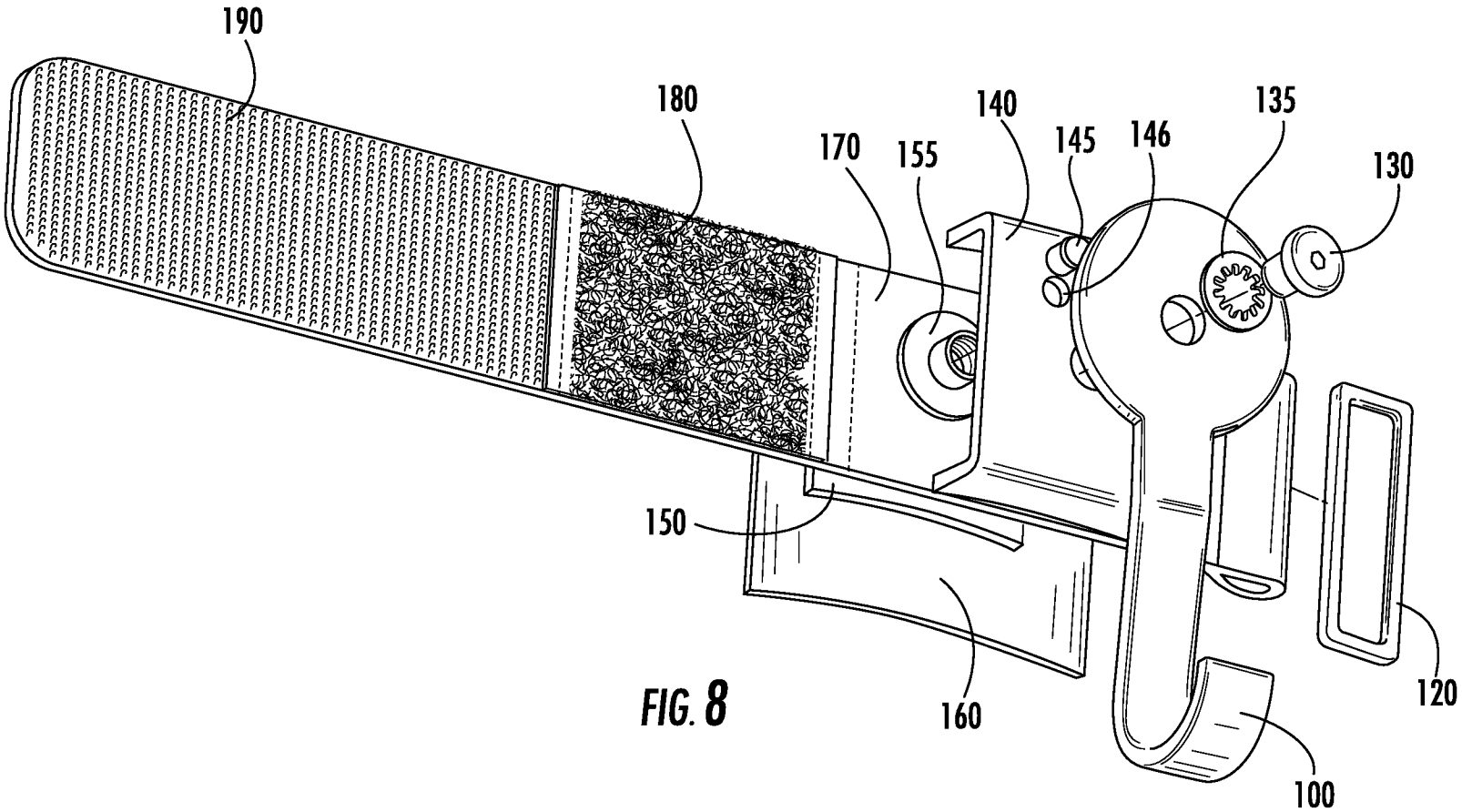
FIG. 8 is an exploded view of the weightlifting swivel wrist hook in accordance with embodiments of the disclosure.

To lock the hook 100 in a desired position, several approaches may be employed. For example, the upper metal base 140 and the circular portion of the hook 100 attached to the upper metal base 140 may have a portion of their material made out of magnets so as to utilize magnetic forces to maintain a desired position. Or the magnets may be attached to the upper metal base 140 and the hook 100 to achieve the desired magnetic forces to hold a desired hook 100 position. Another approach that may be utilized and is discussed further in FIG. 6 and FIG. 8, is the use of a ball catch 145 and indentations.

Figure 2:
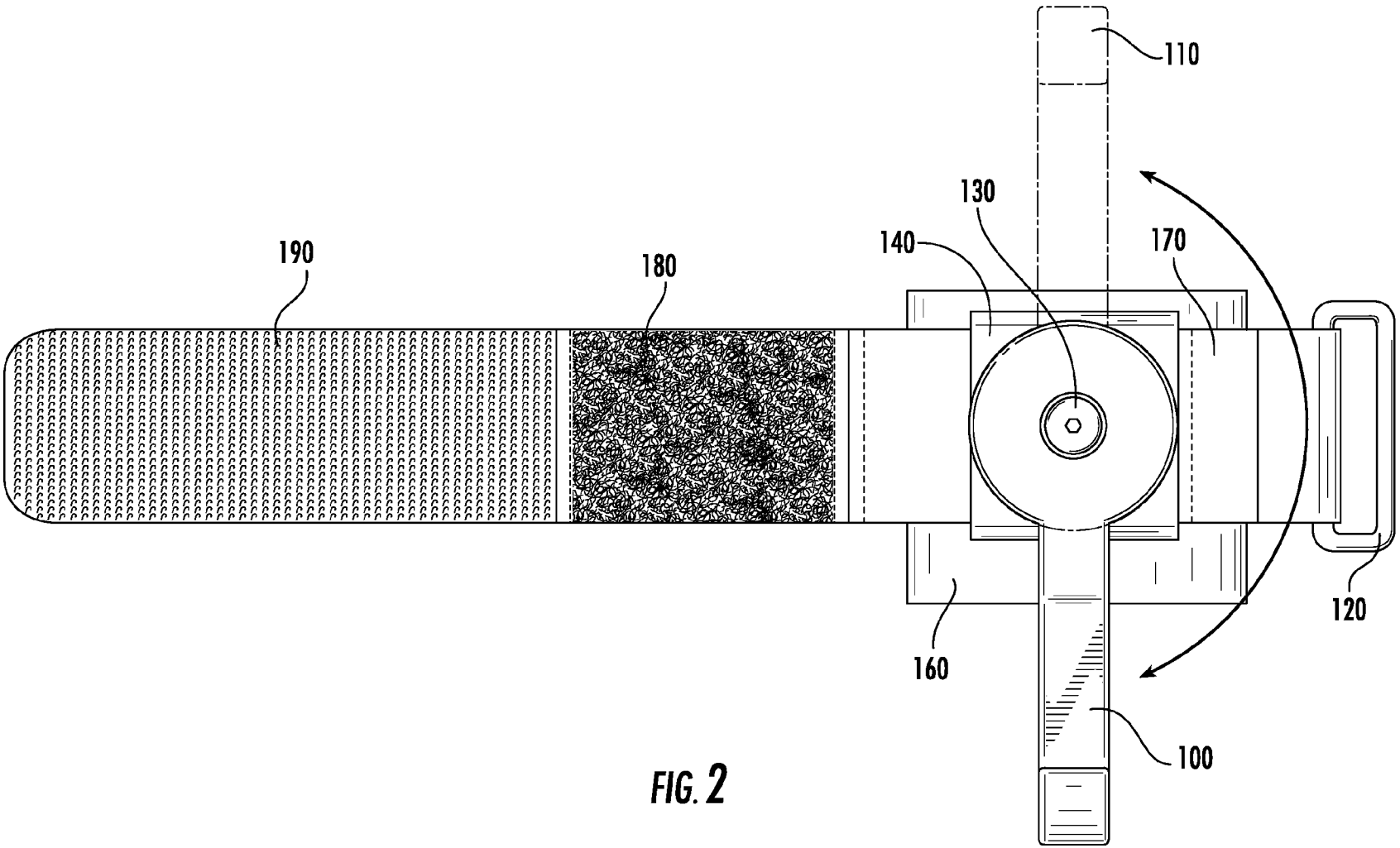
FIG. 2 is a top view of the weightlifting swivel wrist hook in accordance with embodiments of the disclosure.

Reference is next made to FIG. 2, a top view of the weightlifting swivel wrist hook in accordance with embodiments of the disclosure. Illustrated here is a top view of the weightlifting swivel wrist hook also showing the male 190 and female 180 velcro portions of the attachment strap or element 170. Also illustrated is the rotational movement of the hook about the bolt or pivot point 130. In one embodiment, the hook may be moved in the clockwise or counterclockwise direction. In addition, the movement of the hook may be restricted to only a certain degree of movement such as ninety degree movements, one-hundred eighty degree movements, and/or three hundred sixty degree movements. The restriction may be implemented by placement of the magnets or with the ball catch 145 by placement of the indentions in which the ball catch 145 sits to lock into place. In yet another embodiment, the hook 100 is coupled to the upper metal base 140 by a hinge which allows the hook 100 to flip towards the individual in parallel to their arm instead of rotating. The hook 100 can be locked into this not in the way or not in use position by securing the hook 100 to a loop or other fastening means.

Figure 3:
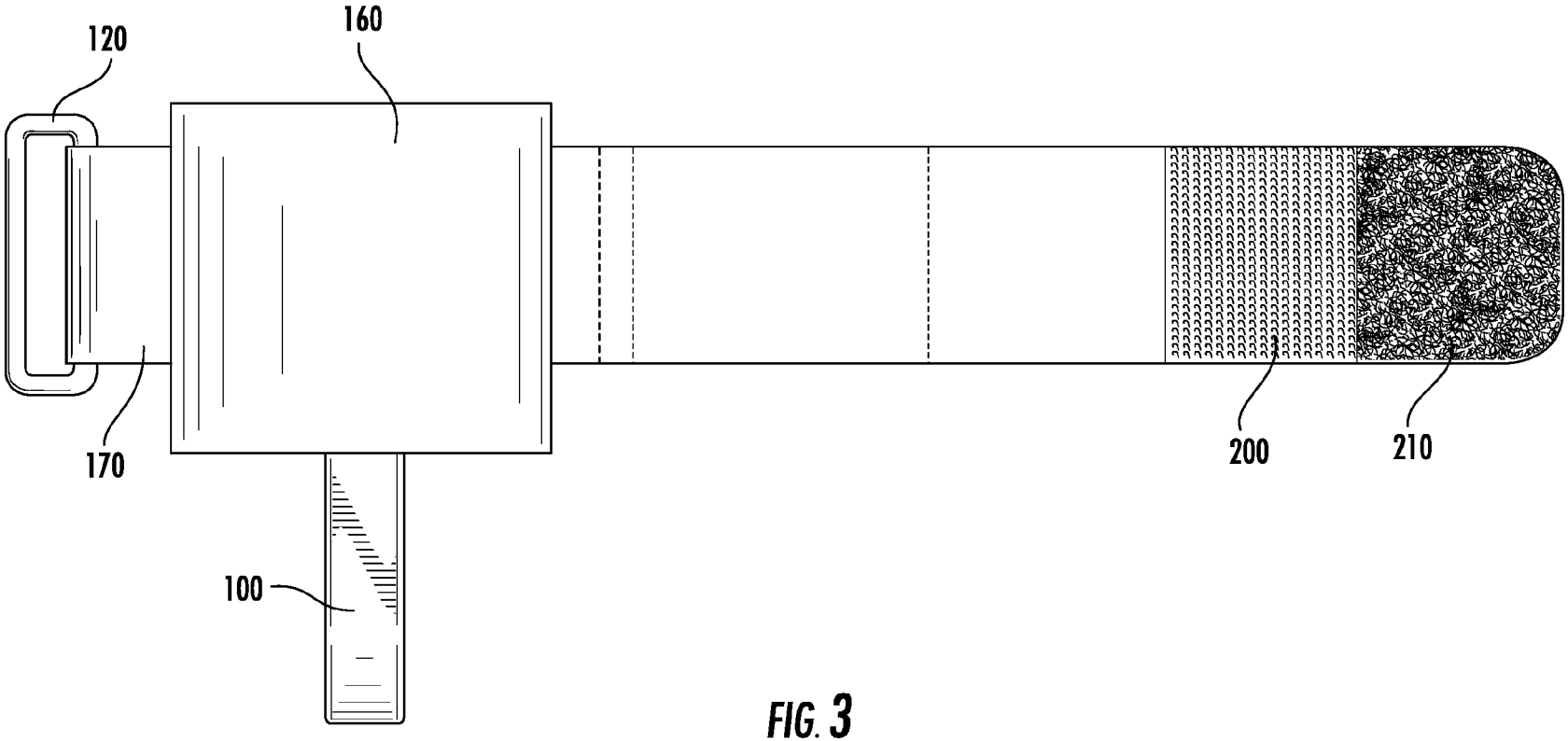
FIG. 3 is a bottom view of the weightlifting swivel wrist hook in accordance with embodiments of the disclosure.

Reference is now made to FIG. 3, a bottom view of the weightlifting swivel wrist hook in accordance with embodiments of the disclosure. In this view illustrated are the female velcro portion 210 of the bottom side of the strap 170 and the male velcro portion 200 of the bottom side of the strap 170 which are used to secure the weightlifting swivel wrist hook to the individual.

Figure 4:
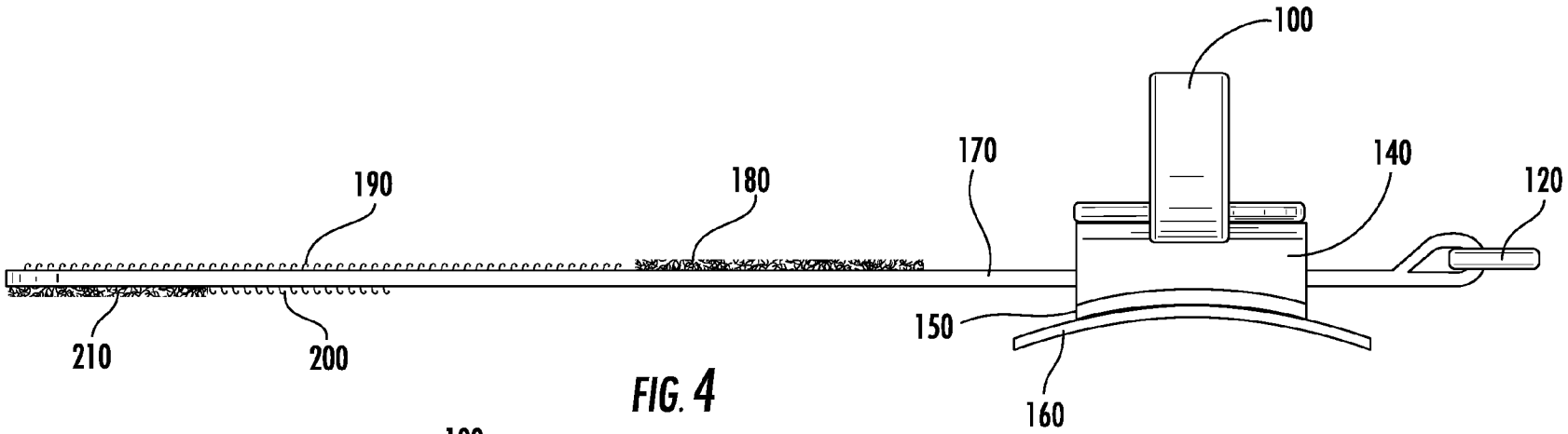
FIG. 4 is a front view of the weightlifting swivel wrist hook in accordance with embodiments of the disclosure.
Figure 5:
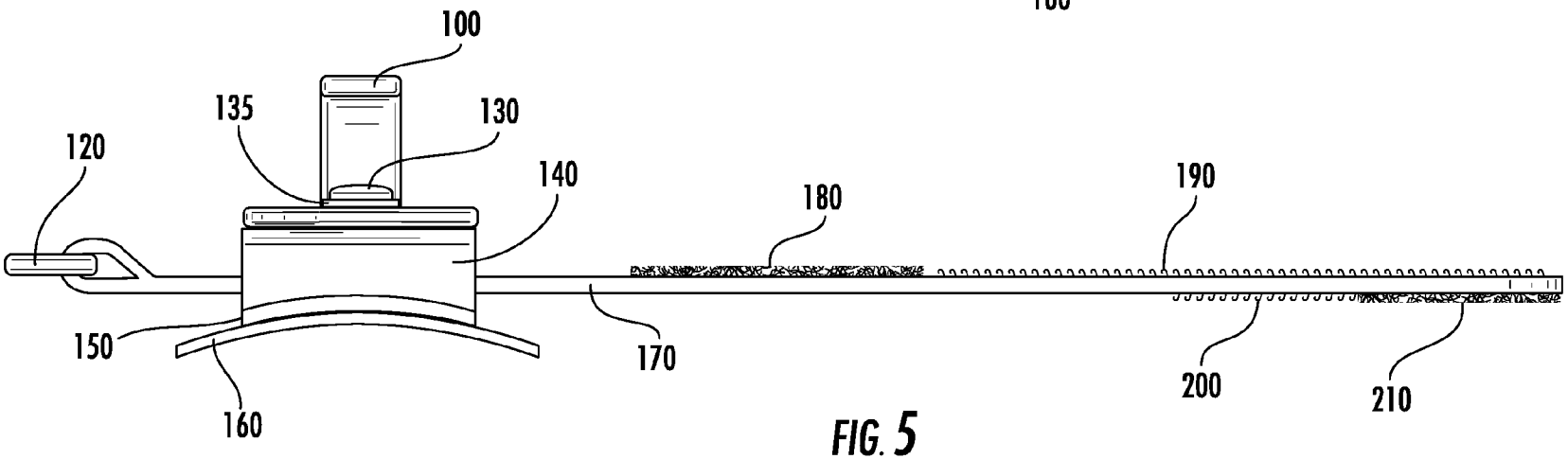
FIG. 5 is a back view of the weightlifting swivel wrist hook in accordance with embodiments of the disclosure.

Reference is next made to FIG. 4 and FIG. 5, a front and back view of the weightlifting swivel wrist hook in accordance with embodiments of the disclosure. In this illustration it is more readily seen the top and lower velcro portions of the attachment strap or element 170.

Figure 7:
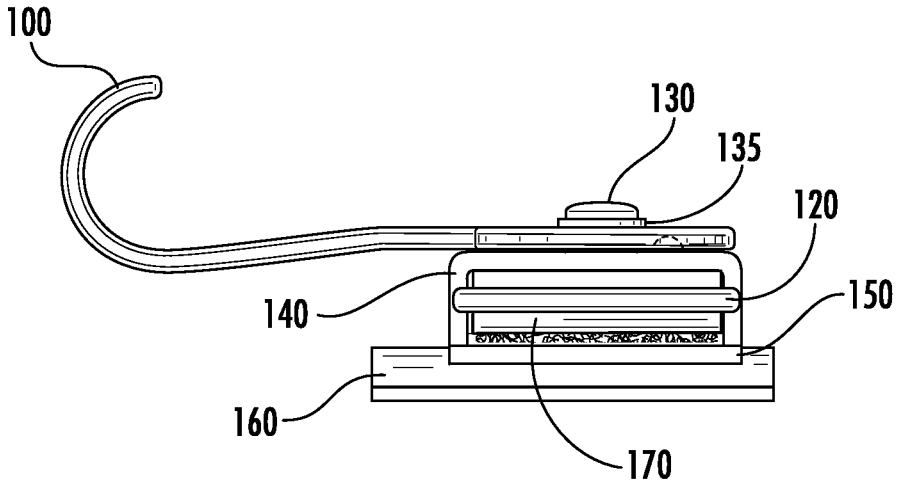
FIG. 7 is a left view of the weightlifting swivel wrist hook in accordance with embodiments of the disclosure.

Reference is now made to FIG. 6 and FIG. 7, a right and left view of the weightlifting swivel wrist hook in accordance with embodiments of the disclosure. Illustrated here more clearly is the nut 155, the ball catch attachment hole 146, and the ball catch 145. Also seen is the ball catch indention that is located on the bottom side of the circular portion of the hook 100. It is an indention that allows the ball catch 145 to lock into place and secure the position of the hook 100. In FIG. 6 the ball catch 145 is seen protruding into the bottom side of the circular portion of the hook 100 or indentation. One or more indentations may be placed around the bottom side circular portion of the hook 100 to lock the hook 100 in desired positions such as the in use position or a number of out of use positions.

Reference is next made to FIG. 8, an exploded view of the weightlifting swivel wrist hook in accordance with embodiments of the disclosure. In this illustration, the components that are more easily seen are the bolt 130, the star lock washer 135, the ball catch 145, the ball catch attachment hole 146, and the nut 155.

Figure 9:
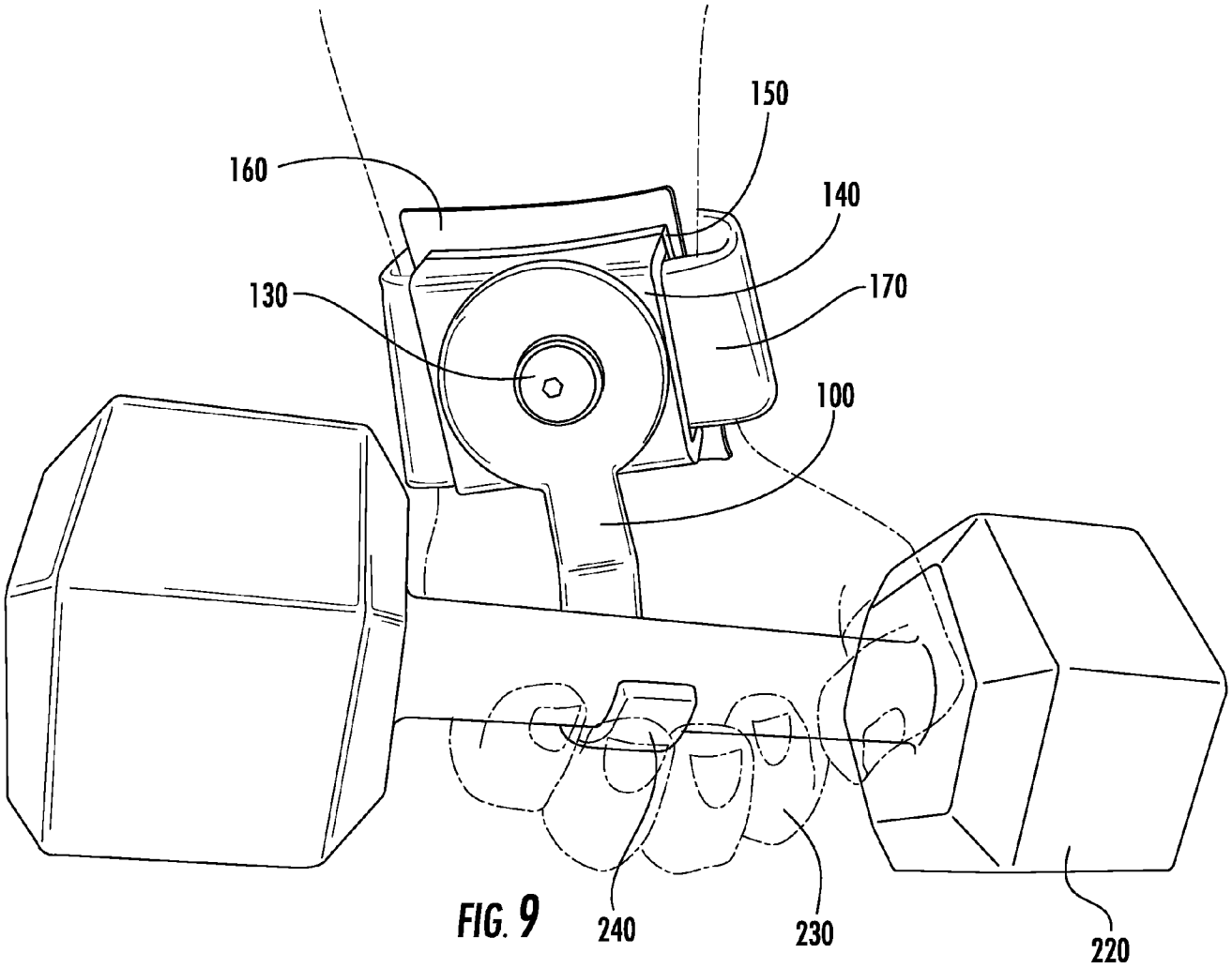
FIG. 9 is an in use view of the weightlifting swivel wrist hook illustrating the device attached to an individual and hooked to a dumbbell weight in accordance with embodiments of the disclosure.

Reference is lastly made to FIG. 9, an in use view of the weightlifting swivel wrist hook illustrating the device attached to an individual and hooked 240 to a dumbbell weight 220 in accordance with embodiments of the disclosure. In this illustration, the weightlifting swivel wrist hook is seen on the left wrist of an individual and is attached or hooked 240 to a dumbbell 220. The fingers 230 of the individual wrap over the dumbbell 220 and the attachment portion of the hook 240. In another embodiment, the weightlifting swivel wrist hook has a left handed embodiment that allows the hook 100 to swivel clockwise only one hundred eighty degrees and a right handed embodiment that allows the hook 100 to swivel counter clockwise only one hundred eighty degrees. That is the left handed and right handed embodiments will have two hook 100 locking positions of in use and out of the way. As illustrated, the out of the way position will have the hook 100 running up the inside forearm of the individual.

In brief, the device is directed to a weightlifting swivel wrist hook, an aid that an individual would couple to their hand to assist in the lifting of weights in an exercise or fitness environment.

The disclosed device and method is generally described, with examples incorporated as particular embodiments of the invention and to demonstrate the practice and advantages thereof. It is understood that the examples are given by way of illustration and are not intended to limit the specification or the claims in any manner.

To facilitate the understanding of this invention, a number of terms may be defined below. Terms defined herein have meanings as commonly understood by a person of ordinary skill in the areas relevant to the present invention. Terms such as "a", "an", and "the" are not intended to refer to only a singular entity, but include the general class of which a specific example may be used for illustration. The terminology herein is used to describe specific embodiments of the invention, but their usage does not delimit the disclosed device or method, except as may be outlined in the claims.

Alternative applications for this invention include using this device outside the fitness or health environment where weights are lifted by hand. Consequently, any embodiments comprising a one piece or multi piece device having the structures as herein disclosed with similar function shall fall into the coverage of claims of the present invention and shall lack the novelty and inventive step criteria.

It will be understood that particular embodiments described herein are shown by way of illustration and not as limitations of the invention. The principal features of this invention can be employed in various embodiments without departing from the scope of the invention. Those skilled in the art will recognize, or be able to ascertain using no more than routine experimentation, numerous equivalents to the specific system and method of use described herein. Such equivalents are considered to be within the scope of this invention and are covered by the claims.

All publications and patent applications mentioned in the specification are indicative of the level of those skilled in the art to which this invention pertains. All publications and patent application are herein incorporated by reference to the same extent as if each individual publication or patent application was specifically and individually indicated to be incorporated by reference.

In the claims, all transitional phrases such as "comprising," "including," "carrying," "having," "containing," "involving," and the like are to be understood to be open-ended, i.e., to mean including but not limited to. Only the transitional phrases "consisting of" and "consisting essentially of," respectively, shall be closed or semi-closed transitional phrases.

The device and/or methods disclosed and claimed herein can be made and executed without undue experimentation in light of the present disclosure. While the device and methods of this invention have been described in terms of preferred embodiments, it will be apparent to those skilled in the art that variations may be applied to the device and/or methods and in the steps or in the sequence of steps of the method described herein without departing from the concept, spirit, and scope of the invention.

More specifically, it will be apparent that certain components, which are both shape and material related, may be substituted for the components described herein while the same or similar results would be achieved. All such similar substitutes and modifications apparent to those skilled in the art are deemed to be within the spirit, scope, and concept of the invention as defined by the appended claims.

What is claimed is:

1. A weightlifting hook comprising:

an attachment element for allowing an individual to attach the weightlifting hook to their arm or wrist;

a hooking element for allowing the individual to hook weights used for weightlifting;

a swivel element configured:

to allow movement of said hooking element about said attachment element;

and locking of said hooking element at a desired position;

whereas the attachment element, hooking element, and swivel element are coupled.

2. The weightlifting hook of claim 1 wherein said hooking element is a hook.

3. The weightlifting hook of claim 1 wherein said attachment element is a strap.

4. The weightlifting hook of claim 1 wherein said swivel element comprises a bolt that serves as a pivot point of rotation for said hooking element.

5. The weightlifting hook of claim 1 wherein said swivel element comprises a hinge that serves as a swivel point of rotation for said hooking element.

6. The weightlifting hook of claim 1 wherein said swivel element comprises a bolt which serves as a pivot point of rotation for said hooking element and said swivel element allows the locking of said hooking element in an in use position or an out of use position.

7. The weightlifting hook of claim 1 wherein said swivel element comprises a hinge which serves as a swivel point of rotation for said hooking element and said swivel element allows the locking of said hooking element in an in use position or an out of use position.

8. The weightlifting hook of claim 1 wherein said locking of said hooking element at a desired position is by the use of magnets.

9. The weightlifting hook of claim 1 wherein said locking of said hooking element at a desired position is by the use of a ball catch and indentations.

10. The weightlifting hook of claim 1 wherein said hooking element is a hook; said attachment element is a strap; said swivel element comprises a bolt which serves as a pivot point of rotation for said hooking element and said swivel element allows the locking of said hooking element in an in use position or an out of use position.

11. The weightlifting hook of claim 1 wherein said hooking element is a hook; said attachment element is a strap; said swivel element comprises a bolt which serves as a pivot point of rotation for said hooking element; said swivel element allows the locking of said hooking element in an in use position or an out of use position; and said locking of said hooking element at a desired position is by the use of magnets.

12. The weightlifting hook of claim 1 wherein said hooking element is a hook; said attachment element is a strap; said swivel element comprises a bolt which serves as a pivot point of rotation for said hooking element; said swivel element allows the locking of said hooking element in an in use position or an out of use position; and said locking of said hooking element at a desired position is by the use of a ball catch and indentations.

* * * * *